US012534282B1

(12) United States Patent
Watson

(10) Patent No.: US 12,534,282 B1
(45) Date of Patent: Jan. 27, 2026

(54) COMBINATION BUSINESS FORM AND CARD SYSTEM

(71) Applicant: Rekon, LLC, Pittsburg, KS (US)

(72) Inventor: Will Watson, Fort Scott, KS (US)

(73) Assignee: Rekon, LLC, Pittsburg, KS (US)

( * ) Notice: Subject to any disclaimer, the term of this patent is extended or adjusted under 35 U.S.C. 154(b) by 99 days.

(21) Appl. No.: 18/465,568

(22) Filed: Sep. 12, 2023

Related U.S. Application Data

(60) Provisional application No. 63/375,361, filed on Sep. 12, 2022.

(51) Int. Cl.
*B65D 77/28* (2006.01)
*B65D 73/00* (2006.01)

(52) U.S. Cl.
CPC ..... *B65D 77/28* (2013.01); *B65D 73/0028* (2013.01)

(58) Field of Classification Search
CPC ..... B65D 77/28; B65D 73/0028; B65D 75/54
USPC ..... 206/232, 223, 776, 484, 579; 229/307, 229/313
See application file for complete search history.

(56) References Cited

U.S. PATENT DOCUMENTS 8,807,332 B1 * 8/2014 Pascua ..... A45C 11/182 206/39
9,460,580 B1 * 10/2016 Glass ..... B65D 73/0078
10,275,698 B2 * 4/2019 Pascua ..... G06K 19/18
10,276,070 B2 * 4/2019 Pascua ..... G09F 3/10
11,214,091 B2 * 1/2022 Pascua ..... B42D 25/20
11,702,264 B2 * 7/2023 Kumar ..... B65D 75/566 206/462
2014/0093664 A1 * 4/2014 Thomas ..... B44F 1/10 428/29
2015/0166218 A1 * 6/2015 Banducci ..... B65D 73/0071 206/471
2016/0009439 A1 * 1/2016 Armstrong ..... B65D 5/22 206/509
2016/0031624 A1 * 2/2016 Pascua ..... B32B 9/045 206/459.1
2017/0127779 A1 * 5/2017 Liguori ..... B65D 73/0028

FOREIGN PATENT DOCUMENTS

EP 3133029 A2 * 2/2017 ..... B65D 73/0007

* cited by examiner

*Primary Examiner* — Rafael A Ortiz
(74) *Attorney, Agent, or Firm* — AVEK IP, LLC

(57) ABSTRACT

A combination form includes a single ply having a first portion with a first printable coating on a first side of said form and a second printable coating on a second side of said form opposing said first side. The form includes a second portion having a third printable coating on said first side. The form includes lines of weakness arranged between said first portion and said second portion. The form includes a laminate sheet arranged in said second portion, said laminate sheet having a top edge and an opposing bottom edge permanently affixed to said combination form, and a first side edge and an opposing second side edge unaffixed to said combination form. The form includes a card having information, said card being arranged in said second portion between said combination form and said laminate sheet, said card being adhered to said combination form.

20 Claims, 6 Drawing Sheets

COMBINATION BUSINESS FORM AND CARD SYSTEM

CROSS REFERENCE TO RELATED APPLICATIONS

This application claims priority to U.S. Provisional Patent Application No. 63/375,361, filed Sep. 12, 2022, the disclosure of which is incorporated herein in its entirety by reference.

FIELD OF THE DISCLOSURE

The disclosure relates generally to the field of combination forms. Specifically, the disclosure relates to a form having associated therewith a distinct, removable card.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the techniques described herein relate to a combination form. The combination form includes a single ply having a first portion with a first printable coating on a first side of said combination form and a second printable coating on a second side of said combination form opposing said first side. The combination form includes a second portion having a third printable coating on said first side. The combination form includes lines of weakness arranged between said first portion and said second portion. The combination form includes a laminate sheet arranged in said second portion, said laminate sheet having a top edge and an opposing bottom edge permanently affixed to said combination form, and a first side edge and an opposing second side edge unaffixed to said combination form. The combination form includes a card having information, said card being arranged in said second portion between said combination form and said laminate sheet, said card being adhered to said combination form.

In some aspects, the techniques described herein relate to a combination form, wherein said card is configured to be removable from said combination form by a user via one of said first side edge and said second side edge.

In some aspects, the techniques described herein relate to a combination form, wherein said adhesive includes a plurality of dots of removable adhesive.

In some aspects, the techniques described herein relate to a combination form, wherein said plurality of dots of removable adhesive is arranged in a pattern corresponding to a shape of said card.

In some aspects, the techniques described herein relate to a combination form, wherein said card is one of a collectible card and a trading card.

In some aspects, the techniques described herein relate to a combination form, wherein said card is a promotional offer.

In some aspects, the techniques described herein relate to a combination form, wherein said laminate sheet includes a colored coating configured to obscure said card when said card is adhered to said combination form.

In some aspects, the techniques described herein relate to a combination form, wherein said colored coating is a UV-curable ink coating.

In some aspects, the techniques described herein relate to a combination form, wherein said combination form is configured to be printable while said card is adhered to said combination form.

In some aspects, the techniques described herein relate to a combination form, wherein said first printable coating, said second printable coating, and said third printable coating are configured to receive printed matter from one of laser printing, inkjet printing, thermal transfer printing, and direct thermal printing.

In some aspects, the techniques described herein relate to a combination form, further including a first set of printed matter arranged on said first printable coating and a second set of printable matter arranged on said second printable coating, wherein said first set of printable matter is disparate from said second set of printable matter.

In some aspects, the techniques described herein relate to a combination form, wherein said single ply is constructed of paper.

In some aspects, the techniques described herein relate to a combination form, wherein said laminate sheet is constructed of polyester.

In some aspects, the techniques described herein relate to a combination form, wherein said laminate sheet is one of translucent and transparent.

In some aspects, the techniques described herein relate to a combination form. The combination form includes a first portion having a first printable coating on a first side of said combination form and a second portion having a second printable coating on said first side. The combination form includes lines of weakness arranged between said first portion and said second portion. The combination form includes a laminate sheet arranged in said second portion, said laminate sheet having a top edge and an opposing bottom edge permanently affixed to said combination form, and a first side edge and an opposing second side edge unaffixed to said combination form. The combination form includes a card having information, said card being arranged in said second portion between said combination form and said laminate sheet, said card being temporarily adhered to said combination form.

In some aspects, the techniques described herein relate to a combination form, wherein said card is removable from said combination form by a user via one of said first side edge and said second side edge.

In some aspects, the techniques described herein relate to a combination form, wherein said laminate sheet further includes a coating configured to obscure said card from view by a user while said card is temporarily adhered to said combination form.

In some aspects, the techniques described herein relate to a combination form, wherein said coating is a white UV-curable ink coating.

In some aspects, the techniques described herein relate to a combination form, wherein said card is one of a collectible card, a trading card, a promotional offer, and a raffle ticket.

In some aspects, the techniques described herein relate to a combination form. The combination form includes a first printable coating and a laminate sheet, said laminate sheet having a first edge affixed to said combination form, and a second edge unaffixed to said combination form. The combination form includes a card having information, said card being arranged between said combination form and said laminate sheet, said card being temporarily adhered to said combination form. Said card is configured to be dissociated from said combination form by a hand of a user via said second edge.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Figure 1:
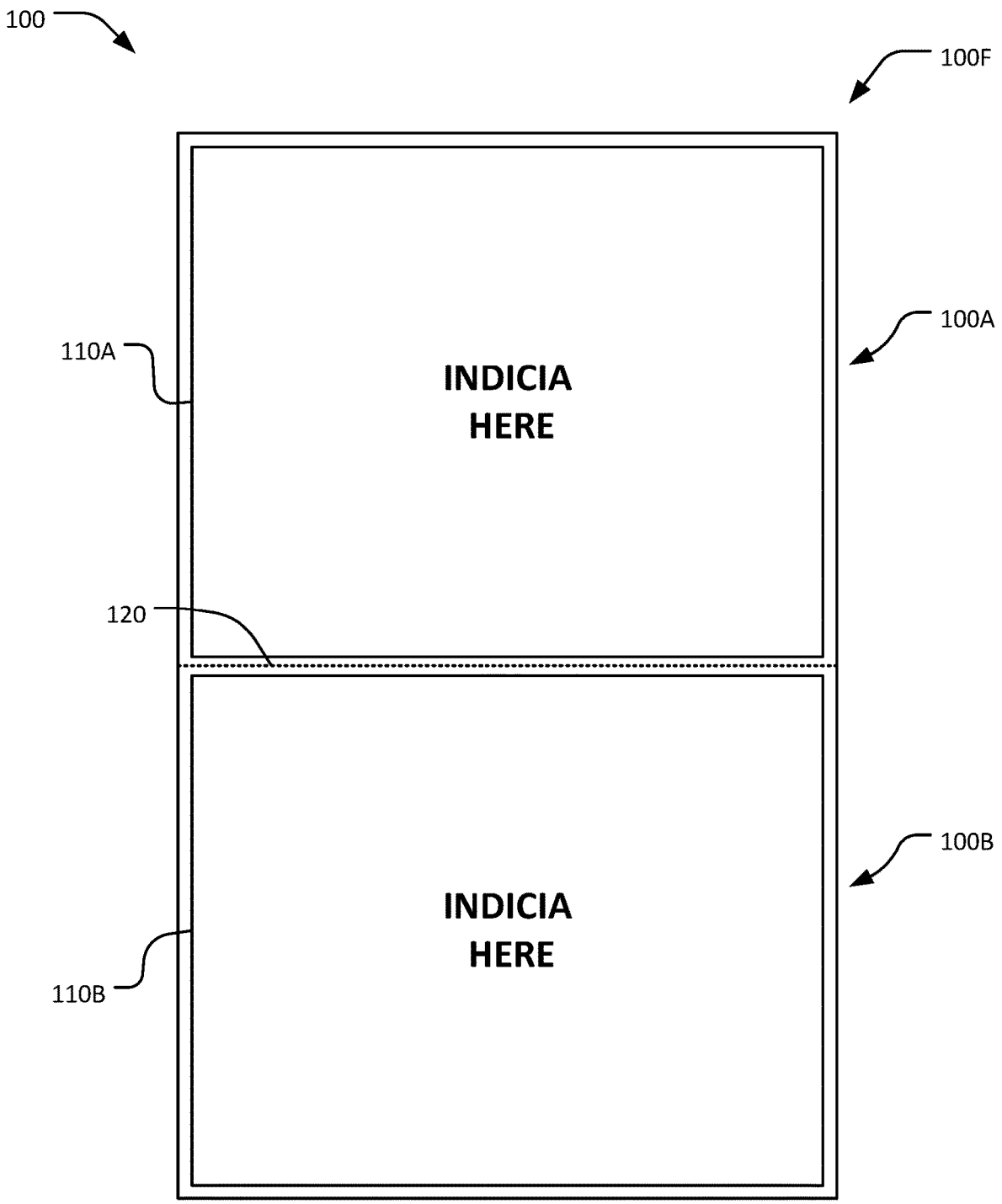
FIG. 1 is a front view of a combination form according to an embodiment of the disclosure.
Figure 2:
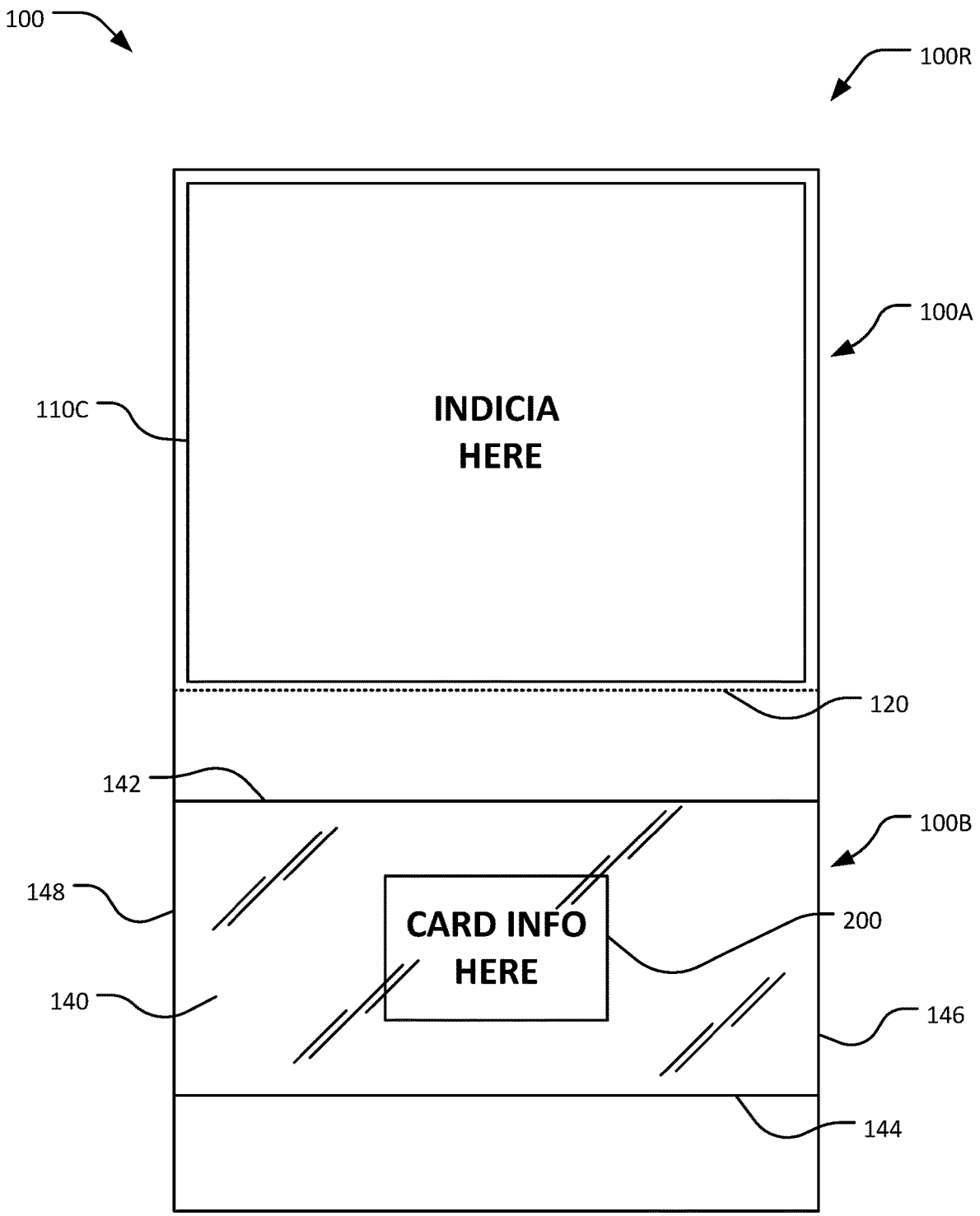
FIG. 2 is a rear view of the combination form of FIG. 1 with a card.
Figure 3:
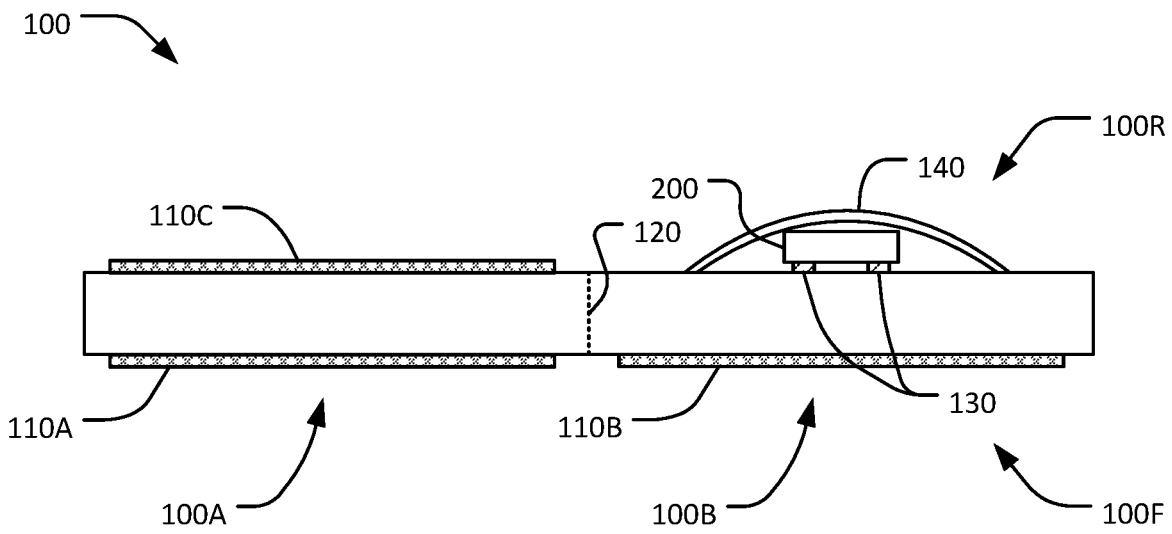
FIG. 3 is a schematic side view of the combination form of FIG. 1.
Figure 4:
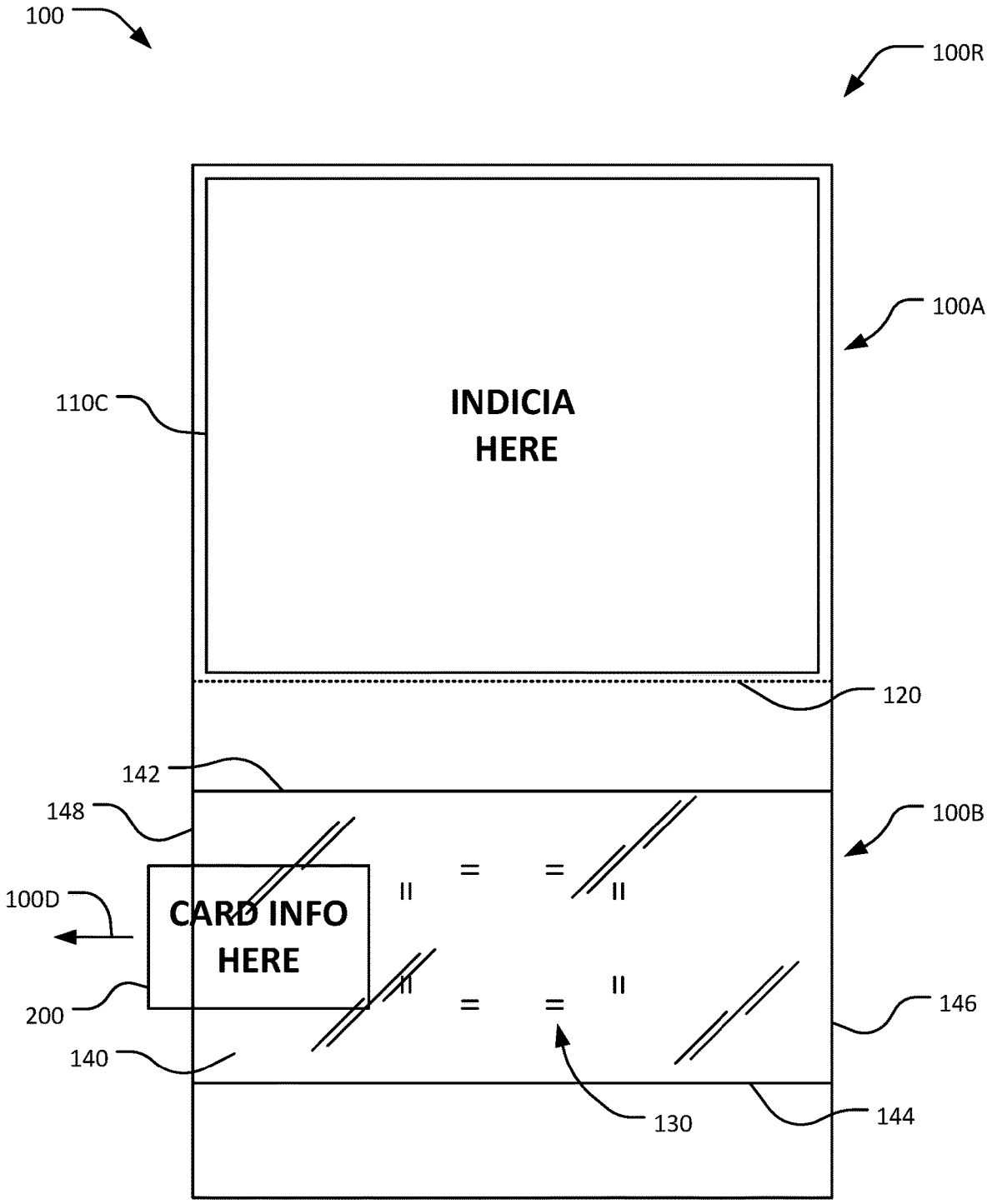
FIG. 4 is another rear view of the combination form of FIG. 1, as the card is being removed.
Figure 5:
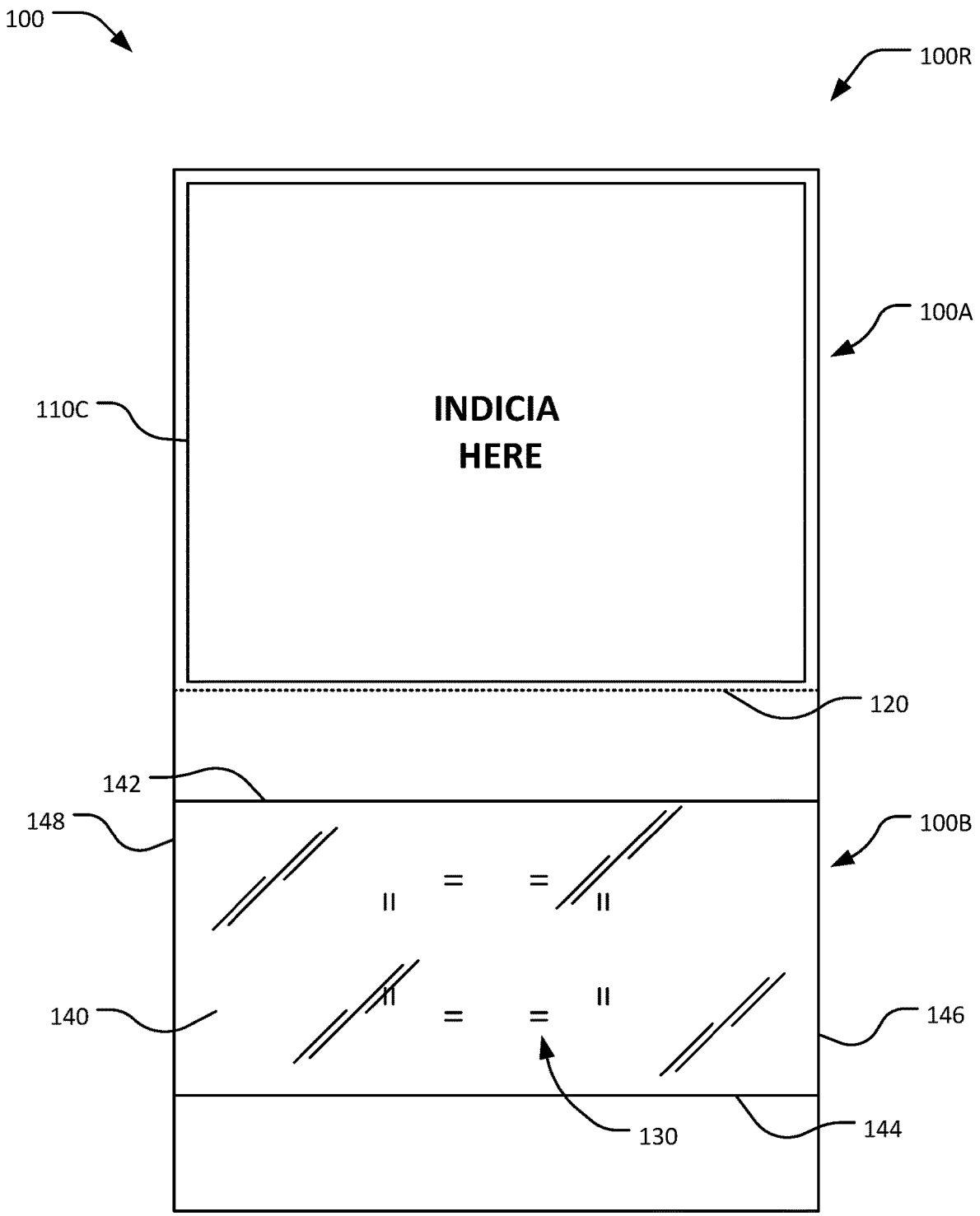
FIG. 5 is yet another rear view of the combination form of FIG. 1, after the card is removed.

FIGS. 1-5 show a combination form 100 having a card 200 associated therewith. The card 200 may be temporarily coupled to the combination form 100 such that the card 200 may be removed by a user. For example, the card 200 may be releasably secured to the combination form 100 by an adhesive 130 located on a side (e.g., a rear side 100R) (FIGS. 3 and 4) of the form 100. The card 200 may be sandwiched between the combination form 100 and a laminate sheet 140. The card 200 may be any suitable type of card or other substrate now known or subsequently developed. The card 200 may have different (e.g., smaller) dimensions than the combination form 100 the card 200 is associated with. In embodiments, the card 200 may be constructed from a disparate material from the combination form 100.

The combination form 100 may be a single ply paper sheet configured to receive indicia (e.g., printed matter, text, barcodes, images, etc.) on one or more of a front side 100F and the rear side 100R thereof. The combination form 100 may be inherently printable and/or may be made printable with a printable coating configured to receive printed matter from a desired printing type (e.g., laser, inkjet, offset, direct thermal, thermal transfer, et cetera). The combination form 100 may be divided into one or more sections 100A and 100B via lines of weakness 120 (e.g., perforations, die cuts, etc.) that are exploitable by a user to dissociate the sections 100A and 100B. In some aspects, each section 100A and 100B may have one or more printable coatings associated therewith for the reception of printed matter. For example, the first section 100A may have a first printable coating 110A on the form front side 100F and a third printable coating 110C on the form rear side 100R, and the second section 100B may have a second printable coating 110B. Each of the printable coatings 110A, 110B, and 110C may be the same type of coating, or, in some embodiments, may be different from each other. Indicia printed on each of the printable coatings 110A, 110B, and 110C may be disparate. In embodiments, the form 100 may be configured for duplex printing by having printable coatings on each of the front side 100F and the rear side 100R.

A laminate sheet 140 may cover a portion of one side of the combination form 100, this portion of the combination form 100 being where location the card 200 is placed. The laminate sheet 140 may be a polyester sheet fixedly secured (e.g., via adhesive, staples, etc.) to the form 100 in a manner which permits a user's hand or other tool to reach between the laminate sheet 140 and the combination form 100. For example, the laminate sheet 140 may be secured to the combination form 100 along one or more edges of the laminate sheet 140 (e.g., a top edge 142 and an opposing bottom edge 144), and one or more other edges may remain unsecured to the combination form 100 (e.g., a side edge 146 and an opposing side edge 148). The laminate sheet 140 may be see-through (e.g., by having transparent or translucent properties). In embodiments, the laminate sheet 140 is secured using an adhesive 130 (e.g., one or more dots of temporary and/or releasable adhesive arranged in a pattern corresponding to a shape of the card 200), such as one that is compatible with the type of printing used to impart matter on the form 100 (e.g., a hot melt adhesive, a tack adhesive, et cetera).

The card 200 may be any suitable card now known or subsequently developed, which may contain any suitable type or form of indicia. The card 200 may be any suitable material, which may be a disparate material from the combination form 100 in some embodiments. The card 200 may be, for example, a collectible or collector card, a trading card, a business card, a coupon, a promotional offer, a raffle or lottery ticket, et cetera. The card 200 may be situated between the laminate sheet 140 and the combination form 100 until the user reaches between the two layers to remove the card 200. The card 200 may be temporarily held in place using the removable adhesive 130 (e.g., "fugitive" glue or "credit-card" glue). In operation, the temporary adhesive 130 may selectively hold the card 200 in place until the user dissociates the card 200 from the combination form 100 (e.g., in a direction 100D away from the form 100, out of one of the edges 146 or 148).

The combination form 100 disclosed herein may function by providing a form which may both contain printed indicia, such as text and graphics, and the separate card 200. The laminate sheet 140 enables the combination form 100 to be safely printed (e.g., using any suitable printing technology such as laser, inkjet, direct thermal, thermal, transfer, etc.) after the card 200 is already secured to the form 100. The laminate sheet 140 may preclude the card 200 from catching on printer parts, or otherwise jamming within the printer. The laminate sheet 140 may also serve to protect the card 200 until the card 200 is ready for removal by the user.

Figure 6:
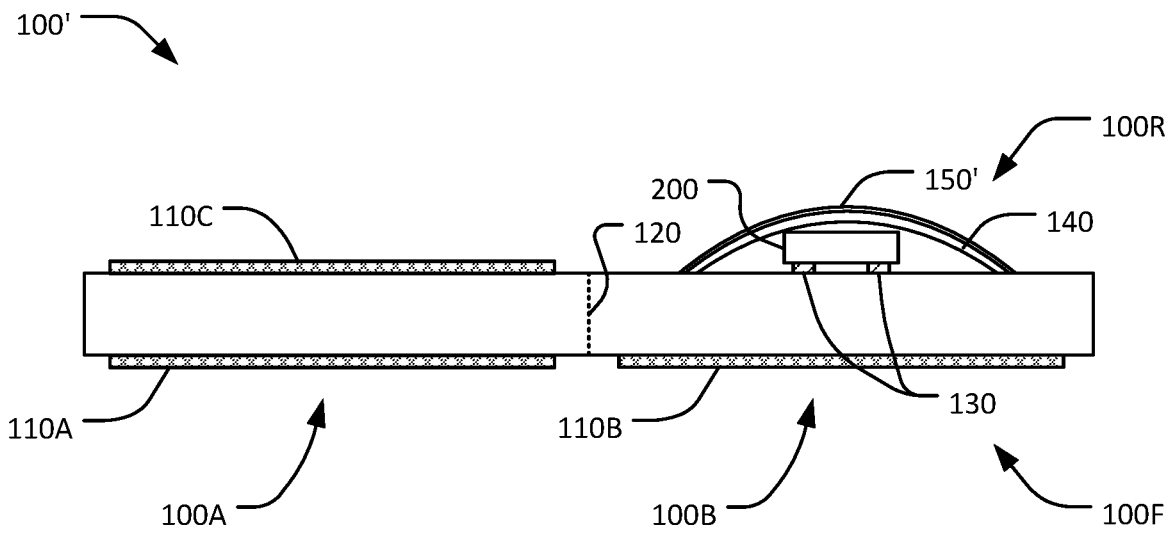
FIG. 6 is a schematic side view of a combination form with a card, according to another embodiment of the disclosure.

FIG. 6 depicts a schematic side view of a combination form 100' that is substantially the same or similar to the form 100, except where noted or would be inherent. One difference between the form 100' and the form 100, is that the form 100' may have an ink coating 150' arranged on the laminate sheet 140. The ink coating 150' may be a UV-curable colored coating (e.g., colored white) that obscures the card 200 from view. After receiving the form 100', the user may dissociate the card 200 from between the form 100' and the laminate sheet 140 to reveal information printed on the card 200.

While the card 200 and laminate sheet 140 have been largely described with the use of the combination forms 100 and 100' herein, this need not be the case in every application. In some embodiments, the collector card 200 and laminate sheet 140 may be used with any other suitable business form now known or subsequently developed. For instance, the card 200 and laminate sheet 140 may each be located on a single side of the business form, thus transforming the business form into the combination form described herein. In embodiments, a preexisting business form may be retrofit with the laminate sheet 140 and card 200 in accordance with the disclosure. Furthermore, the artisan would understand that the drawings are not to scale and may have exaggerated proportions for the purpose of illustrating the concepts herein. For example, the laminate sheets 140 shown in FIGS. 3 and 6 may sit relatively flush with the rest of the form 100 and 100', respectively, in reality. In embodiments, the combination forms 100 and 100' may be constructed of paper, though this need not be the case (e.g., the combination forms 100 and 100' may be constructed of another suitable material such as polyester. In more embodiments, the laminate sheet 140 may be constructed of polyester.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims. Not all steps listed in the various figures need be completed in the specific order described.

The invention claimed is:

1. A combination form, comprising:

a single ply having:

a first portion having a first printable coating on a first side of said combination form and a second printable coating on a second side of said combination form opposing said first side; and a second portion having a third printable coating on said first side;

lines of weakness arranged between said first portion and said second portion;

a laminate sheet arranged in said second portion, said laminate sheet having an entirety of both a top edge and an opposing bottom edge permanently affixed to said combination form, and an entirety of both a first side edge and an opposing second side edge unaffixed to said combination form; and a card having information, said card being arranged in said second portion between said combination form and said laminate sheet, said card being adhered to said combination form with an adhesive.

2. The combination form of claim 1, wherein said card is configured to be removable from said combination form by a user via one of said first side edge and said second side edge.

3. The combination form of claim 1, wherein said adhesive comprises a plurality of dots of removable adhesive.

4. The combination form of claim 3, wherein said plurality of dots of removable adhesive is arranged in a pattern corresponding to a shape of said card.

5. The combination form of claim 1, wherein said card is one of a collectible card and a trading card.

6. The combination form of claim 1, wherein said card is a promotional offer.

7. The combination form of claim 1, wherein said laminate sheet comprises a colored coating configured to obscure said card when said card is adhered to said combination form.

8. The combination form of claim 7, wherein said colored coating is a UV-curable ink coating.

9. The combination form of claim 1, wherein said combination form is configured to be printable while said card is adhered to said combination form.

10. The combination form of claim 1, wherein said first printable coating, said second printable coating, and said third printable coating are configured to receive printed matter from one of laser printing, inkjet printing, thermal transfer printing, and direct thermal printing.

11. The combination form of claim 10, further comprising a first set of printed matter arranged on said first printable coating and a second set of printable matter arranged on said second printable coating, wherein said first set of printable matter is disparate from said second set of printable matter.

12. The combination form of claim 1, wherein said single ply is constructed of paper.

13. The combination form of claim 1, wherein said laminate sheet is constructed of polyester.

14. The combination form of claim 1, wherein said laminate sheet is one of translucent and transparent.

15. A combination form, comprising:

a first portion having a first printable coating on a first side of said combination form;

a second portion having a second printable coating on said first side;

lines of weakness arranged between said first portion and said second portion;

a laminate sheet arranged in said second portion, said laminate sheet having an entirety of both a top edge and an opposing bottom edge permanently affixed to said combination form, and an entirety of both a first side edge and an opposing second side edge unaffixed to said combination form; and a card having information, said card being arranged in said second portion between said combination form and said laminate sheet, said card being temporarily adhered to said combination form.

16. The combination form of claim 15, wherein said card is removable from said combination form by a user via one of said first side edge and said second side edge.

17. The combination form of claim 15, wherein said laminate sheet further comprises a coating configured to obscure said card from view by a user while said card is temporarily adhered to said combination form.

18. The combination form of claim 17, wherein said coating is a white UV-curable ink coating.

19. The combination form of claim 15, wherein said card is one of a collectible card, a trading card, a promotional offer, and a raffle ticket.

20. A combination form, comprising:

a first printable coating;

a laminate sheet, said laminate sheet having a first edge and a third edge permanently affixed to said combination form, and a second edge and a fourth edge unaffixed to said combination form;

a line of weakness adjacent the laminate sheet; and a card having information, said card being arranged between said combination form and said laminate sheet, said card being temporarily adhered to said combination form;

wherein;

said card is configured to be dissociated from said combination form by a hand of a user via said second edge;

said first edge and said third edge are each permanently affixed in their entirety to said combination form;

said second edge and said fourth edge are each unaffixed in their entirety to said combination form; and said card is entirely obscured from view when assembled with said laminate sheet and said combination form.

* * * * *